United States Patent [19]

Hansel, III

[11] Patent Number: 4,707,040

[45] Date of Patent: Nov. 17, 1987

[54] CONNECTOR FOR COAXIALLY SHIELDED CABLE

[75] Inventor: George A. Hansel, III, Newark, Del.

[73] Assignee: W. L. Gore & Associates, Inc., Newark, Del.

[21] Appl. No.: 758,853

[22] Filed: Jul. 26, 1985

Related U.S. Application Data

[63] Continuation of Ser. No. 512,754, Jul. 11, 1983, abandoned, which is a continuation-in-part of Ser. No. 295,824, Aug. 24, 1981.

[51] Int. Cl.[4] ..... H01R 31/08

[52] U.S. Cl. ..... 439/510; 439/578; 439/816; 439/98

[58] Field of Search ..... 339/14, 177 R, 177 E, 339/176 MP, 143 R, 147 R, 147 P, 19, 256 R

[56] References Cited

U.S. PATENT DOCUMENTS

| | | | |
|---|---|---|---|
| 3,260,791 | 7/1966 | Shelley | 174/68.5 |
| 3,488,625 | 1/1970 | Collin | 339/177 |
| 3,587,028 | 6/1971 | Vberbacher | 339/14 R |
| 3,587,029 | 6/1971 | Knowles | 339/14 R |
| 3,601,756 | 8/1971 | Stroh | 339/19 |
| 3,648,222 | 3/1972 | Cowmeadow | 339/14 R |
| 3,743,979 | 7/1973 | Schor | 339/143 R |
| 3,951,497 | 4/1976 | Balzano et al. | 339/19 |
| 4,020,430 | 4/1977 | Vander Heyden | 339/143 R |
| 4,026,014 | 5/1977 | Sugimoto et al. | 339/176 MP |
| 4,029,377 | 6/1977 | Guglielmi | 339/19 |
| 4,269,469 | 5/1981 | Audic | 339/177 R |
| 4,288,916 | 9/1981 | Verma | 174/36 |
| 4,337,989 | 7/1982 | Asick et al. | 339/143 R |
| 4,352,534 | 10/1982 | Johnson | 339/19 |
| 4,389,080 | 6/1983 | Clark et al. | 339/14 R |
| 4,396,242 | 8/1983 | Kurano et al. | 339/14 R |

FOREIGN PATENT DOCUMENTS 1558383 12/1979 United Kingdom .

OTHER PUBLICATIONS

IBM Tech. Discl. Bull. "Multiple Shielded Wire Connector", Jan. 1966, vol. 8, No. 8.

*Primary Examiner*—Gil Weidenfeld
*Assistant Examiner*—David Pirlot
*Attorney, Agent, or Firm*—Finnegan, Henderson, Farabow, Garrett & Dunner

[57] ABSTRACT

A connector for connecting cnductors of coaxially shielded cables to standard, non-coaxial male contacts disposed in a row including (a) a first inner contact compatible with each of the male contacts, and being electrically and mechanically connected to a first inner conductor of one of the coaxially shielded cables; (b) an electrically insulating element surrounding the first inner contact; (c) an outer rectangular contact surrounding the insulating element, and electrically and mechanically connected to an outer conductor of one of the coaxially shielded cables and fastened to the jacket of that cable; and (d) an auxiliary contact disposed among the male contacts and electrically connecting one or more of the outer contacts to one or more of the male contacts or to an external circuit.

8 Claims, 7 Drawing Figures

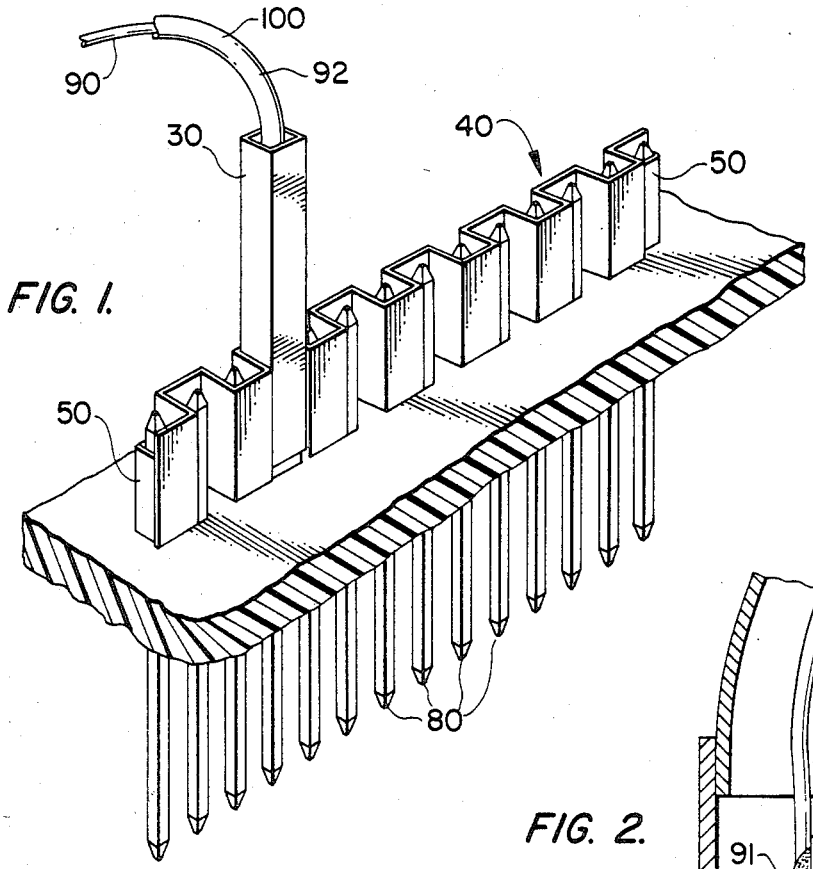
FIG. 1.
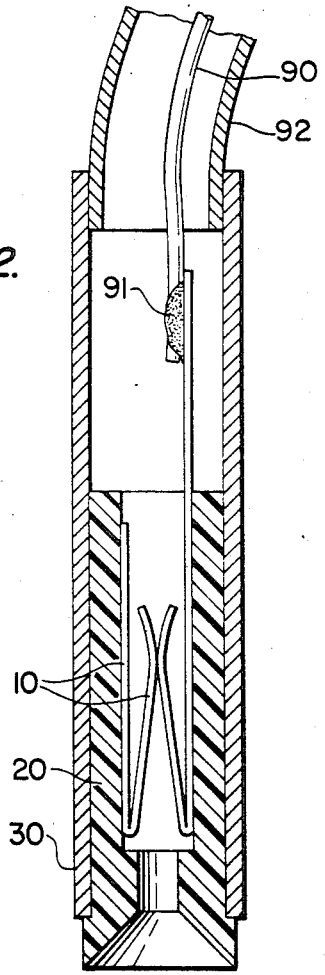
FIG. 2.
FIG. 5.
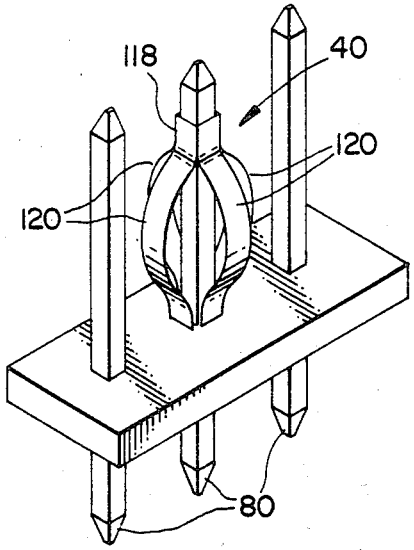

CONNECTOR FOR COAXIALLY SHIELDED CABLE

BACKGROUND OF THE INVENTION

This application is a continuation of Ser. No. 512,754, filed July 11, 1983, now abandoned, which was a continuation-in-part of U.S. Pat. Application Ser. No. 295,824 filed Aug. 24, 1981.

FIELD OF THE INVENTION

This invention relates to connectors for connecting conductors of coaxially shielded cables to non-coaxially shielded square posts or round pin male contacts.

DESCRIPTION OF THE PRIOR ART

Coaxially shielded cables are well known as the highest fidelity signal wiring for digital signals and analog signals through the microwave frequency range. The advent of large scale integrated circuits has increased the density and complexity of electronic circuitry to the point where coaxially shielded cables are often required for interconnection in high density applications. However, the usefulness of coaxially shielded cables has been limited by cumbersome and time consuming connection methods.

SUMMARY OF THE INVENTION

An object of the present invention is to provide a connector which allows the use of coaxially shielded cables in existing, well-developed hardware systems for packaging electronic circuitry.

In accordance with the object of the invention, as embodied and broadly described herein, a connector for connecting conductors of a coaxially shielded cable to standard, non-coaxially shield square post or round pin male contacts disposed in a row comprises: a first inner contact compatible with the male contacts, and electrically and mechanically connected to the first inner conductor of the coaxially shielded cable; an electrically insulating element surrounding the first inner contact; an outer contact surrounding the insulating element, and electrically and mechanically connected to the outer conductor of the coaxially shielded cable and fastened to the jacket of the coaxially shielded cable; and an auxiliary contact disposed among the male contacts and electrically connecting one or more of the outer contacts to one or more of the male contacts or to a external circuit.

BRIEF DESCRIPTION OF THE DRAWING

FIG. 1 is a perspective view of the first embodiment according to the invention showing the auxiliary contact;

FIG. 2 is an axial cross-sectional view of a portion of a first embodiment according to the invention showing the first inner contact, the outer contact and the insulating element;

FIG. 5 is a perspective view of a third embodiment according to the present invention;

DESCRIPTION OF THE PREFERRED EMBODIMENTS

Figure 3:
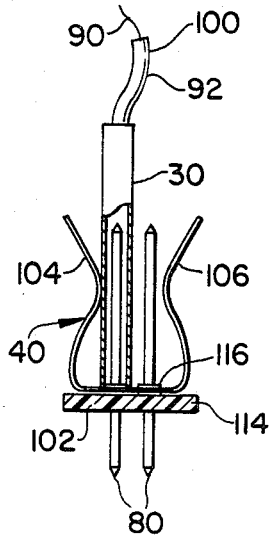
FIG. 3 is an axial cross-sectional view of a portion of a second embodiment according to the present invention.

A first embodiment of a coaxial connector according to the present invention is described with reference to FIGS. 1 and 2 wherein like elements have like numbers. A first inner contact 10 comprising a standard contact, which is fully compatible with the standard, noncoaxial round pin or square post male contacts 80 commonly used in packaging electronic circuitry, is connected to a first inner conductor 90 of a coaxial cable 100 at junction 91. The standard square post male contacts 80 have lengths varying from approximately 0.2" to approximately 1" and transverse facial dimensions of 0.025"×0.025". Round pin male contacts are typically between 0.020" and 0.035" in diameter.

An electrically insulating medium 20 surrounds the first inner contact 10 and extends axially along the surface of the first inner contact 10.

The insulating medium 20 is surrounded by an outer contact 30 to which is connected an outer conductor 92 of a coaxial cable 100. The axes of the first inner contact 10 and the outer contact 30 are substantially parallel. The outer contact 30 is a hollow rectangular solid having a transverse face of which the dimension of one side is slightly smaller than the center-to-center distance of the standard male contacts 80. This center-to-center distance can be as small as 0.100".

An auxiliary contact 40 is installed among a row of standard male contacts 80 by connecting a socket 50 thereof onto a standard male contact 80 so that the auxiliary contact 40 contacts an outer contact 30 whenever that outer contact 30 is connected to one of the standard male contacts 80 disposed in a row.

The auxiliary contact 40 can be made from a strip of any highly conductive material. The shape of the auxiliary contact 40 is such that a portion of the auxiliary contact 40 contacts a portion of the outer contact 30 whenever an outer contact 30 is connected to one of the standard male contacts disposed in a row. For example, the auxiliary contact 40 can be shaped as a square wave and installed among a row of standard male contacts 80 such that whenever an outer contact 30 is connected to one of the standard male contacts, three axial faces of that outer contact 30 contact portions of the auxiliary contact 40. Of course, other shapes are possible which will also provide sufficient contact between the auxiliary contact 40 and an outer contact 30.

The outer contact 30 can be selectively supplied with an electrically insulating coating to leave exposed only portions of the outer contact 30 which serve as electrical contact points.

The advantage of the auxiliary contact 40 is that the outer conductors of several coaxial cables can be efficiently connected together and to the electronic circuitry. This prevents a wasting of space that otherwise occurs if the outer conductors are separately tied together or if each outer conductor is separately tied to the electronic circuitry. For example, the outer conductors can all be tied to ground by connecting the socket 50 of the auxiliary contact 40 to a standard male contact which is grounded. This eliminates the need for separately grounding each outer conductor.

A modification of this embodiment can be achieved by selectively applying an electrically insulating coating to the outer contact 30 and to the auxiliary contact 40 to leave said contacts exposed substantially only at their interface.

Figure 4:
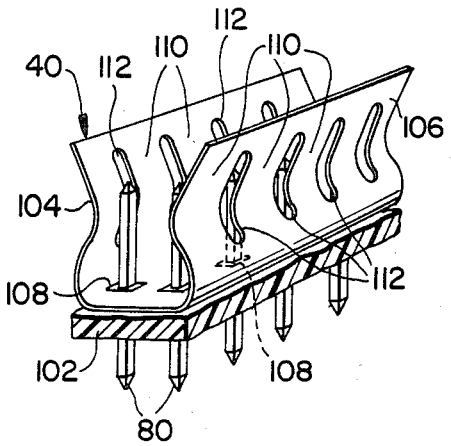
FIG. 4 is a perspective view of the second embodiment of the present invention shown in FIG. 3.

Another embodiment of a coaxial connector according to the present invention will now be discussed with reference to FIGS. 3 and 4. FIG. 4 is a perspective view of a second embodiment of the invention, whereas FIG. 3 is a cross-sectional view of the second embodiment. According to this second embodiment, auxiliary contact 40 includes a base portion 102 having two resilient side portions 104 and 106 extending therefrom. As illustratively shown in FIGS. 3 and 4, the cross-sectional dimension of auxiliary contact 40 is preferably an inverted omega shape, although other dimensioning may be utilized, as discussed further hereinbelow.

Base portion 102 of auxiliary contact 40 is provided with a plurality of holes 108 arranged in spacial alignment symmetrically about each of male contacts 80. In this fashion, auxiliary contact 40 may be disposed among the male contacts such that each of male contacts 80 passes through a corresponding one of holes 108. Furthermore, each of male contacts 80 extends generally parallel to side portions 104 and 106, without contacting either side.

As shown in FIG. 3, when an inner contact 10 (not shown) is fitted onto a male contact 80, the corresponding outer contact 30 mechanically and electrically connects with the adjacent one of side portions 104 and 106. In the case of FIG. 3, outer contact 30 engages with side portion 104, whereas a second inner contact 10 (not shown) placed over the other male contact 80 shown in FIG. 3 would result in connection between its outer contact 30 and side portion 106.

As set forth above, side portions 104 and 106 are resilient, which provides for secure electrical and mechanical engagement with outer contact 30. That is, in the absence of an outer contact 30, side portion 104 would be displaced slightly towards the right in FIG. 3. As the inner contact is forced down onto one of the male contacts 80, corresponding outer contact 30 engages and subsequently displaces side portion 104 towards the left. Due to the resilient nature of side portion 104, this contact is able to 30 be maintained over numerous insertion and removal operations.

So that the presence of one outer contact 30 will not displace one of side portions 104 and 106 to an extent such that an adjacent outer contact 30 would not be able to make contact therewith, each side portion 104 and 106 is comprised of a plurality of longitudinal ribs 110 defining a corresponding plurality of slots 112, according to a preferred arrangement of this embodiment. These are arranged such that the longitudinal median of each rib lies in the same plane as the central axis of the immediately adjacent male contact 80. Conversely, the center of each slot 112 corresponds to the space between the adjacent male contacts 80. In this manner, each outer contact 30 connects with a unique one of ribs 110 such that the presence of a first outer contact 30 and corresponding displacement of the contacting side portion has substantially no effect upon placement of adjacent ribs. Thus, consistent electrical contact may be maintained regardless of the number or positioning of outer contacts 30.

Auxiliary contact 40 according to the second embodiment may be maintained in place amongst male contacts 80 by being directly affixed to the plastic medium 114 in which male contacts 80 are disposed. This may be accomplished, for example, by gluing base portion 102 to medium 114 in a well known fashion, or by utilizing any other suitable means for securing one element to another. To assist in positioning auxiliary contact 40 with respect to male contacts 80, medium 114 may be provided with a raised portion 116 coaxially aligned with each one of male contacts 80. By making each of holes 108 sufficiently large to encase raised portion 116, accurate positioning of auxiliary contact 40 is accomplished in that the cooperation of raised portions 116 with holes 108 causes appropriate centering of each male contact within its corresponding hole.

In general, it is desirable to avoid electrical connection between auxiliary contact 40 and male contacts 80. By means of the raised portion 116 described above, the auxiliary contact may be disposed among the male contacts such that each of the latter protrudes through a corresponding hole 108 without contacting any edges thereof. It is to be recognized, however, that at some point it may be desirable to provide electrical connection between the auxiliary contact and a selected one or more of male contacts 80 inasmuch as this arrangement can be used to provide a ground connection to all of the outer contacts 30 connected to the auxiliary contact. This coupling may be accomplished in any one of many well known ways for electrically connecting two components. For instance, the selected one of male contacts 80 may be directly wired to the adjacent section of base portion 102 of auxiliary contact 40, or an outer contact 30 may be provided in which the inner contact 10 thereof is shunted to the outer contact, or one or more of the holes 108 can be made small enough that the base portion 102 directly connects to one or more of the male contacts 80.

The auxiliary contact 40 can be made from any highly conductive material having the resiliency sufficient to obtain consistent electrical connection with an outer contact 30. According to a preferred embodiment, auxiliary contact 40 is made from a unitary leaf of springy metal which has been folded to form the generally U-shaped configuration illustrated in FIGS. 3 and 4.

A third embodiment of the present invention is shown in perspective view in FIG. 5. According to this embodiment, auxiliary contact 40 has a top portion 118 compatible with one of male contacts 80, and a plurality of resilient side portions 120 that are each connected to top portion 118 and extend towards, but are separated from, adjacent male contacts 80. The side portions 120 are shaped so that the end opposite top portion 118 is closely adjacent or contacting the same male contact 80 to which top portion 118 is fitted.

Side portions 120 are resilient in nature and are sufficiently close to adjacent male contacts 80 such that when an inner contact 10 (not shown) is engaged with one of the adjacent male contacts, the corresponding outer contact 30 (not shown) mechanically and electrically connects with the respective side portion 120. The outer contact 30 is thus electrically connected to the male contact 80 on which auxiliary contact 40 is disposed such that the shield of the corresponding cable can be grounded simply by grounding the male contact 80 on which auxiliary contact 40 is positioned.

As shown in FIG. 5, a preferred arrangement of this embodiment of auxiliary contact 40 includes four side portions 120, each side portion extending from top portion 118 at a right angle to the adjacent side portion. In this fashion, up to four shields may be coupled together and to a common circuit element by means of auxiliary contact 40, provided male contacts 80 have been disposed adjacent each side portion 120. Furthermore, by providing a plurality of auxiliary contacts 40 in electrical connection with one another either directly or via intermediate outer contacts 30, more than four shields may be connected together.

As in the case of the auxiliary contacts described in the first and second embodiments, an auxiliary contact according to this third embodiment is preferably made of a resilient or springy metal, and may be constructed from a unitary blank. Alternately, the auxiliary contact may be constructed in parts which are mechanically and electrically coupled, such as by soldering discrete side portions 120 to a separate top portion 118.

Figure 6:
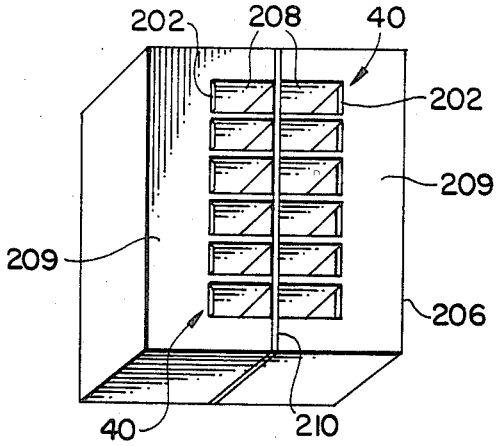
FIG. 6 is a perspective view of the top plan of a fourth embodiment according to the present invention.
Figure 7:
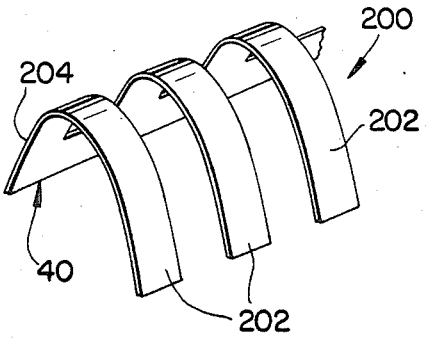
FIG. 7 is a perspective view of the metallic auxiliary contact of the fourth embodiment of the present invention shown in FIG. 6.

A fourth embodiment of the present invention is shown in perspective view in FIG. 6, the auxiliary contact 40 of which is shown in partial perspective view in FIG. 7. According to this embodiment, auxiliary contact 40 comprises a comb 200 having a plurality of separate teeth 202 extending from a common shank 204. Auxiliary contact 40 is preferably made of a springy metal with teeth 202 being crimped and bent back toward the shank, as shown best in FIG. 7.

In order to position auxiliary contact 40 among the male contact ends of a connector according to the present invention, a housing 206 is provided as shown in FIG. 6. According to a presently preferred arrangement of this embodiment, housing 206 is generally rectangular in shape and has a plurality of longitudinal passages 208 extending completely therethrough. Auxiliary contact 40 is disposed in housing 206 by embedding shank 204 of comb 200 into the common wall 209 of housing 206 which is adjacent passages 208. Teeth 202 extend from the wall of housing 206 and are exposed within the interior passages 208. Comb 200 is positioned relative housing 206 such that each one of teeth 202 is exposed within a different one of passages 208. Each tooth 202 within a passage 208 is flush with the common wall 209 of housing 206 at the outwardly facing end (shown) of passage 208, but extends away from the common wall towards the inner end (not shown) of passage 208.

In order to provide a connector according to the present invention, housing 206 with auxiliary contact 40 disposed therein is positioned over a corresponding plurality of male contact posts 80 (as shown in FIG. 3) such that each of passages 208 is positioned over a corresponding one of the male contact posts. Preferably, each male contact post is positioned precisely in the center of the corresponding passage 208 and in a manner such that it does not contact any of the exposed teeth 202 of auxiliary contact 40. Housing 206, once positioned over the male contact posts as described hereinabove, may be affixed to medium 114 (FIG. 3) in which male contact posts 80 are disposed. Housing 206 may be securely affixed to medium 114 by gluing, heat bonding, or other suitable bonding methods. Alternatively, the housing need not be affixed but can be used as a means to connect and disconnect a group of contacts simultaneously.

With the housing and auxiliary contact positioned over and amongst the male contact posts as described above, placing of an inner contact 10 (FIG. 2) over one of the male contact posts 80 will simultaneously result in electrical and mechanical connection between the corresponding outer contact 30 (FIG. 2) and the immediately adjacent tooth 202 of auxiliary contact 40. Additional outer contacts 30 may be inserted into the other passages 208 and, in each case, will result in mechanical and electrical connection with auxiliary contact 40 via teeth 202. In this manner, electrical connection can be made between all of the outer contacts 30 due to the common shank 204 to which each tooth 202 of the auxiliary contact is connected. Furthermore, since each tooth 202 is separated from its adjacent teeth, displacement of one tooth by an outer contact will not affect the ability of the adjacent teeth to maintain connection with a corresponding outer contact.

To ease assembly of housing 206, the housing may be manufactured in separate halves with each half being connected to a central wall 210. Each half of housing 206 is provided with its own auxiliary contact 40 such that, when the halves are assembled together, teeth 202 are disposed within passages 208 directly opposite central wall 210. In this case, the two auxiliary contacts 40 will not be electrically connected to one another so that if electrical coupling of both auxiliary contacts is desired, it will be necessary to provide a separate connecting means. For example, a short length of wire connecting contacts 40 may also be embedded within housing 206.

While auxiliary contact 40 is preferably made of a springy metal, housing 206 is constructed of a plastic or an ABS resin compound which is non-conductive. Housing 206 may be made of the same material as medium 114 (FIG. 3) which supports male contact posts 80. Central wall 210 may likewise be made of a non-conductive material.

It will be apparent to those skilled in the art that modifications and variations can be made in the connector of this invention. The invention in its broader aspects is, therefore, not limited to the specific details, representative apparatus and illustrative examples shown and described. Thus, it is intended that all matter contained in the foregoing description or shown in the accompanying drawings shall be interpreted as illustrative and not in a limiting sense.

What is claimed is:

1. A connector structure for connecting a plurality of coaxial cables to a standard array of non-coaxial male contacts, said connector structure comprising:

(a) a female connector for each said coaxial cable comprising:

(1) an inner contact having a first end compatible with each of said male contacts and an axially-spaced second end electrically and mechanically connected to the inner conductor of said coaxial cable;

(2) an electrically insulating element coaxially surrounding said inner contact; and (3) an outer contact having a rectangular cross-section and coaxially surrounding said insulating element, said outer contact coaxially extending between the first and second ends of said inner contact and being ®1 ®ctrically and mechanically connected to the outer conductor of said coaxial cable proximate the second end of the inner contact;

(b) an auxiliary contact comprising a connector element separable from each of said outer contacts and having a plurality of mechanically and electrically interconnected surfaces, said surfaces being spaced from said male contacts and at least one said surface being disposed adjacent each said male contact for resilient friction-fit type mechanical and electrical connection with a portion of said outer contact when said adjacent male contact is received in said inner contact; and (c) means for electrically and mechanically connecting said auxiliary contact to at least one of said male contacts thereby electrically connecting the outer conductors of all said coaxial cables to said one male contact.

2. The connector assembly according to claim 1, wherein said male contact comprise square posts.

3. The connector assembly according to claim 1 wherein said male contacts comprise round pins.

4. The connector assembly according to claim 1, wherein an insulating coating is selectively applied to the outermost contact and to the auxiliary contact to leave said contacts exposed substantially only at the connection therebetween.

5. The connector assembly according to claim 1, wherein the outer contact of said female connector has dimensions such that at least two of said plurality of female connectors are positionable on adjacent ones of the said array of male contacts.

6. The connector assembly according to claim 5, wherein said auxiliary contact is U-shaped springy metal strip for providing a mechanical and electrical interconnection between said outer contacts.

7. The connector assembly according to claim 5, wherein said auxiliary contact is a square wave-shaped springy metal strip for providing a mechanical and electrical interconnection between said outer contacts.

8. The connector assembly according to claim 7, wherein said square-wave shape of said springy metal strip has a half wavelength corresponding to the spacing between adjacent ones of said male contacts, said auxiliary contact being disposed among said male contacts in an interlocking manner.

* * * * *